US010358266B2

(12) United States Patent
Sagan

(10) Patent No.: US 10,358,266 B2
(45) Date of Patent: Jul. 23, 2019

(54) GARMENT WITH DRAW-CORD CINCHING SYSTEM

(71) Applicant: NIKE, Inc., Beaverton, OR (US)

(72) Inventor: David Sagan, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/941,581

(22) Filed: Mar. 30, 2018

(65) Prior Publication Data

US 2018/0222638 A1 Aug. 9, 2018

Related U.S. Application Data

(62) Division of application No. 14/808,580, filed on Jul. 24, 2015, now Pat. No. 9,932,151.

(51) Int. Cl.

| | |
|---|---|
| ***A41F 9/02*** | (2006.01) |
| ***B65D 33/28*** | (2006.01) |
| ***A44B 99/00*** | (2010.01) |
| ***A45C 3/00*** | (2006.01) |
| ***A45C 13/10*** | (2006.01) |

(52) U.S. Cl.

CPC ..... *B65D 33/28* (2013.01); *A41F 9/025* (2013.01); *A44B 99/00* (2013.01); *A45C 3/00* (2013.01); *A45C 13/1046* (2013.01); *A41D 2300/33* (2013.01)

(58) Field of Classification Search

CPC ..... B65D 33/28; A41F 9/025; A45C 13/1046; A41D 2300/33

USPC ..... 2/84

See application file for complete search history.

(56) References Cited

U.S. PATENT DOCUMENTS

| | | | |
|---|---|---|---|
| D63,031 | S | 9/1923 | Free |
| 1,681,922 | A | 8/1928 | Boch |
| D135,261 | S | 3/1943 | Sloane et al. |
| 2,635,664 | A | 4/1953 | Cohen |
| 3,084,731 | A | 4/1963 | Kugler |
| 4,991,978 | A | 2/1991 | Ostrowski |
| D341,934 | S | 12/1993 | Abraham |
| D355,298 | S | 2/1995 | Beger |
| 5,439,634 | A | 8/1995 | North |
| 5,482,374 | A | 1/1996 | Buhyoff |
| 5,830,119 | A | 11/1998 | Chen |
| D448,927 | S | 10/2001 | Vazquez |

(Continued)

FOREIGN PATENT DOCUMENTS

| | | | |
|---|---|---|---|
| DE | 4244024 | A1 | 9/1994 |
| EP | 578247 | A1 | 1/1994 |
| WO | 9720479 | A1 | 6/1997 |

*Primary Examiner* — Derek J Battisti

(74) *Attorney, Agent, or Firm* — Shook, Hardy & Bacon L.L.P.

(57) ABSTRACT

A draw-cord cinching system includes various elements. For example, the system generally includes a tube having a tubular wall forming a through-channel between a first end of the tube and a second end of the tube. The tubular wall includes at least a first portion with a first amount of pliability and a second portion with a second amount of pliability, which is less than the first portion. The first and second portions may be arranged or located such that the when the tube is shortened, such as by pulling a draw cord positioned in the through-channel, the tubular wall folds or bends at the first portion having a higher amount of pliability than the second portion.

20 Claims, 6 Drawing Sheets

(56) References Cited

U.S. PATENT DOCUMENTS

| | | | | |
|---|---|---|---|---|
| 6,367,976 | B1 | 4/2002 | Bannister | |
| 6,370,692 | B1 | 4/2002 | Duyn et al. | |
| 6,402,377 | B1 | 6/2002 | Vo et al. | |
| D615,756 | S | 5/2010 | Traiger | |
| 8,714,425 | B2 | 5/2014 | Meyer et al. | |
| D706,029 | S | 6/2014 | Lee | |
| 2004/0057638 | A1 | 3/2004 | Perell et al. | |
| 2004/0066987 | A1 | 4/2004 | O'Neill | |
| 2004/0156564 | A1* | 8/2004 | Glasser | B65D 33/28 383/72 |
| 2009/0049668 | A1* | 2/2009 | Tsao | B65D 33/28 24/712 |
| 2009/0205797 | A1 | 8/2009 | Fernandes et al. | |
| 2010/0275344 | A1 | 11/2010 | Demarest et al. | |
| 2010/0303388 | A1* | 12/2010 | Kent | B65D 33/28 383/32 |
| 2010/0319382 | A1* | 12/2010 | Burrini | A47G 9/0215 62/259.3 |
| 2012/0063706 | A1 | 3/2012 | Fraser et al. | |
| 2013/0051708 | A1* | 2/2013 | Cobler | B65D 33/28 383/75 |
| 2013/0068169 | A1* | 3/2013 | Miller | A01K 1/0107 119/161 |
| 2013/0089278 | A1 | 4/2013 | Cobler | |
| 2013/0259408 | A1* | 10/2013 | Borchardt | B32B 3/30 383/119 |
| 2014/0216874 | A1* | 8/2014 | Farrelly | A45C 13/1046 190/109 |
| 2015/0030266 | A1* | 1/2015 | Borchardt | B65D 33/00 383/109 |
| 2015/0273399 | A1* | 10/2015 | Roh | B01D 69/10 427/243 |

* cited by examiner

GARMENT WITH DRAW-CORD CINCHING SYSTEM

CROSS-REFERENCE TO RELATED APPLICATIONS AND CLAIM OF PRIORITY

This non-provisional patent application claims priority to co-pending U.S. patent application Ser. No. 14/808,580, filed Jul. 24, 2015, titled "Draw-Cord Cinching System," having, the entire contents of which is incorporated by reference herein.

TECHNICAL FIELD

The invention relates to draw cord that closes in a substantially pre-determined manner.

BRIEF SUMMARY

This summary is intended to provide a high-level overview of various aspects of the invention and to introduce a selection of concepts that are further described below in the detailed description section. This summary is not intended to identify key or essential features of the claimed subject matter, nor is it intended to be used as an aid in isolation to determine the scope of the claimed subject matter. The scope of the invention is defined by the claims.

In brief, and at a high level, this disclosure describes, among other things, a draw-cord cinching system that includes a draw cord extending through a tubular body and that can be used as a closure mechanism, or size-controlling mechanism, for various articles (e.g., bag, wearable garment, athletic equipment, etc.). Two or more portions of the tubular body have different amounts of pliability, which provides different resistances to folding and/or bending. Higher pliability portions that are less stiff tend to bend or fold in a substantially pre-determined manner when the draw cord is cinched.

In one aspect of the invention, a draw-cord cinching system is provided. The cinching system includes a tubular wall that forms a tube having a through-channel. The through-channel extends from a first end of the tube to a second end of the tube. The tubular wall may include a first portion having a first amount of pliability and a second portion having a second amount of pliability, where the second amount of pliability is less than the first amount of pliability. The second portion may be at least partially circumscribed by the first portion of the tubular wall. A draw cord may be positioned in the through-channel such that when it is pulled, it moves the first end of the tube towards the second end of the tube, shortening the tube and the associated through-channel.

Additionally, the second portion of the wall that is stiffer may include at least one geometric shape demarcated or outlined by the first portion of the tubular wall that is more pliable (e.g., multiple geometric shapes in a repeating pattern with each geometric shape demarcated by the first portion). The geometric shape(s) may be repeated or extended along the tubular wall, and may extend part or all of the way between an internal facing surface of the tubular wall and an external facing surface of the tubular wall. The geometric shape(s) incorporated into the tubular wall may include circles, ovals, ellipses, triangles, squares, trapezoids, or other geometric shapes, and may be the same or varied. In such an example, the geometric shape(s) may naturally fold around the interstitial portions into a pre-designed pattern when the tube is shortened.

The first and second portions of the tubular wall may have their pliability influenced by their respective thicknesses, the number of layers of material incorporated, or through the use of different materials having differing pliabilities, and/or in other ways. Portions of the tubular wall with higher pliability may be incorporated to enhance folding in those areas of the tubular wall, and portions of the tubular wall with lower pliability may be incorporated to increase stiffness in those areas of the tubular wall, to facilitate forming of a desired pattern when the tube is shortened.

In another aspect of the invention, a drawstring-style bag is provided. The bag includes a body portion that at least partially encloses a storage space and an opening for providing access to the storage space. A collar portion may be coupled to the body portion, and may form a perimeter around at least part of the opening. The collar portion may include a tubular structure formed by a tubular wall, with the tubular structure having a through-channel extending from a first end of the tubular structure to a second end of the tubular structure. A first portion of the tubular wall may have a first amount of pliability, and a second portion of the tubular wall may be at least partially circumscribed by the first portion of the tubular wall and may include a second amount of pliability that is less than the first amount of pliability. The bag may further include a draw cord positioned in the through-channel. The draw cord may be operable to reduce a size of the opening by shortening a length of the tubular structure by drawing the first end towards the second end. Tubular wall bends may form along the first portion when the first end is drawn towards the second end.

BRIEF DESCRIPTION OF THE DRAWINGS

The present invention is described in detail herein with reference to the attached figures, which are incorporated herein by reference, wherein.

DETAILED DESCRIPTION

The subject matter of various aspects of the present invention is described with specificity herein to meet statutory requirements. However, the description itself is not intended to limit the scope of the invention. Rather, the claimed subject matter might be embodied or carried out in other ways to include different elements, combinations, components, or steps, including those similar to the ones described in this document, and may be embodied or carried out in conjunction with other present or future technologies.

The present invention generally relates to a draw-cord cinching system that includes a draw cord extending through a tubular body and that can be used as a closure mechanism, or size-controlling mechanism, for various articles (e.g., bag, wearable garment, athletic equipment, etc.). At a high level, the tubular body includes elements that allow the tubular body to collapse in a pre-determined manner when the tubular body is cinched using the draw cord. For example, the tubular wall might include two or more portions having a relative pliability (i.e., stiffness, flexibility, and the like) that is different from one another. As such, the higher pliability portion(s) of the tubular wall tend to bend or fold when the tubular wall is cinched. The pattern of varied-pliability portions can be selected to achieve a substantially pre-determined collapsing (or cinching) arrangement.

Figure 1:
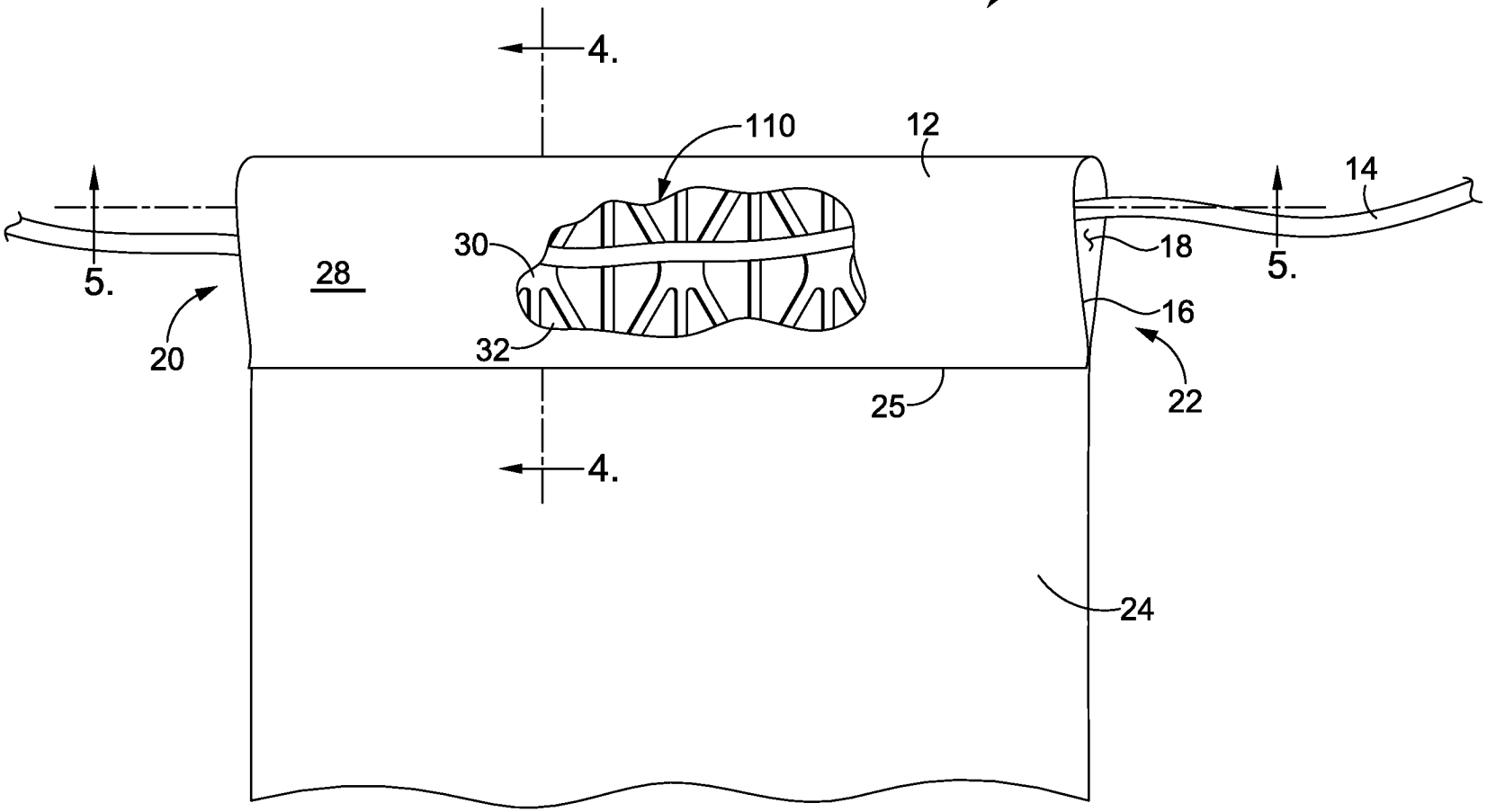
FIG. 1 is a perspective view of an exemplary draw-cord cinching system having a tube and a draw cord, in accordance with an aspect of the present invention.

Having described some general aspects of the invention, reference is now made to FIG. 1, which depicts a perspective view of an exemplary draw-cord cinching system 10 with a tube 12 and a draw cord 14. The tube 12 is formed by a tubular wall 16 and includes a through-channel 18 extending from a first end 20 of the tube 12 to a second end 22 of the tube 12. The draw cord 14 is positioned in the through-channel 18 and can be used to draw the first end 20 of the tube 12 towards the second end 22 of the tube 12 (i.e., shortening the length of the tube 12 and associated through-channel 18). The tube 12 is coupled to an article portion 24, which may be a portion of a bag, sack, or article of apparel, for example. In one aspect, the tube 12 might be formed by folding an edge 25 over and coupling the edge 25 onto the article portion 24, such as by stitching, welding, bonding, or any other suitable fastening technique. In other aspects, the tube 12 might be formed separately from the article portion 24 and then attached to the article portion 24 in a separate step.

FIG. 1 also includes a cutaway view 110, in which a portion of the tubular wall 16 is depicted removed for illustrative purposes. FIG. 1 illustrates that the tubular wall includes a first portion 30 and a second portion 32. In accordance with an aspect of the present invention, the first portion 30 is more pliable (i.e., more flexible, less rigid, less stiff, etc.) than the second portion 32. As such, when the first end 20 of the tube 12 is drawn towards the second end 22 of the tube 12, the tubular wall 16 tends to fold or bend along the first portion 30 as opposed to (or before) the second portion 32. Thus, cinching of the tubular wall 16 can be achieved in a substantially pre-determined manner, which can be tailored by selectively arranging the varied-pliability portions.

Figure 2:
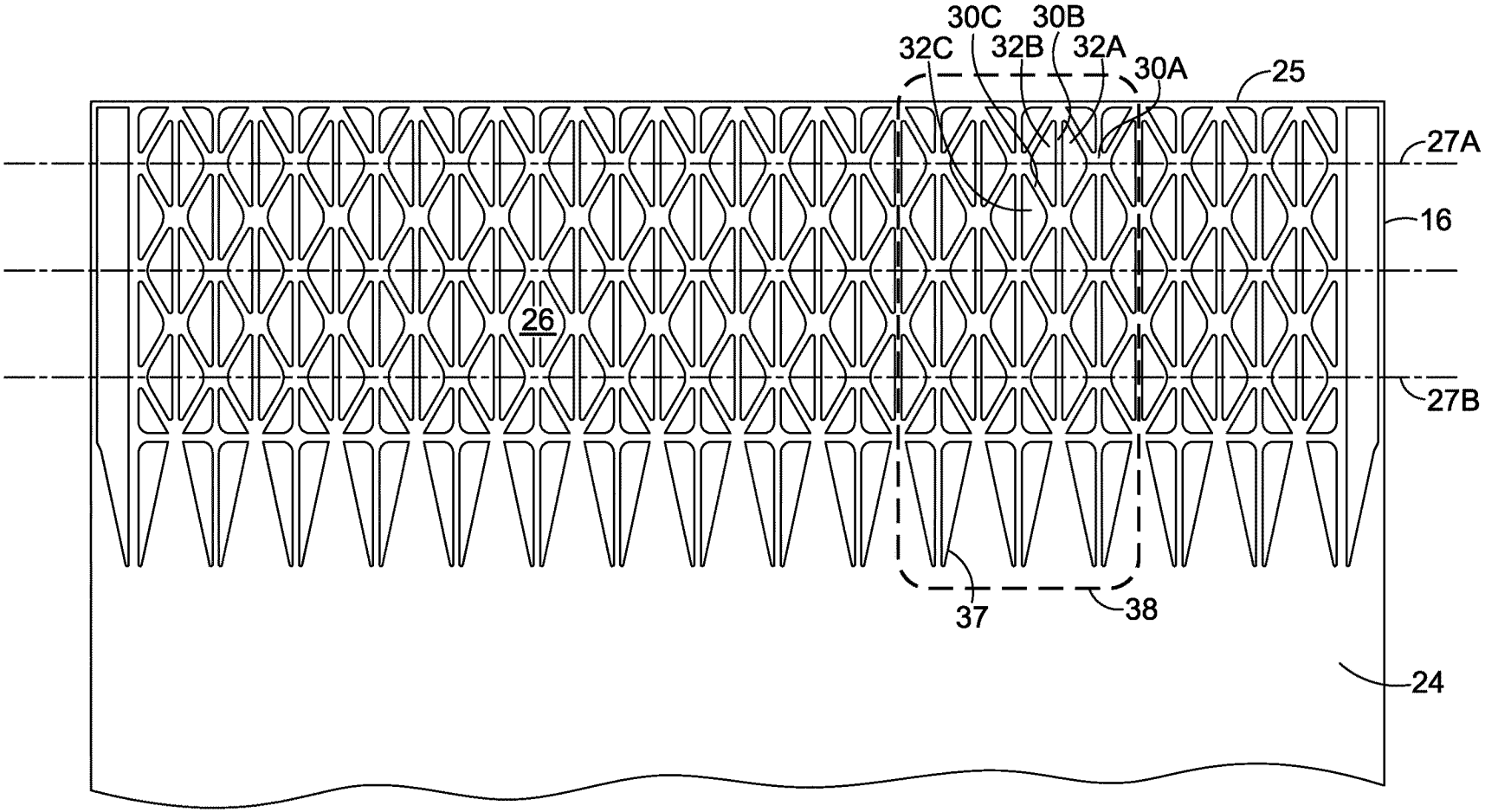
FIG. 2 illustrates an exemplary pattern of varied-pliability portions that might be arranged along the tube depicted in FIG. 1 in accordance with an aspect of the present invention.

To further illustrate how the first and second portions might be arranged, reference is now made to FIG. 2, which illustrates a side plan view of an internal surface 26 of the tubular wall 16 when the edge 25 is decoupled. That is, in FIG. 1, the edge 25 is folded over and coupled onto the article portion 24 near reference lines 27A and 27B to form the tube 12. In FIG. 2, the edge 25 is depicted decoupled to illustrate how the more rigid second portions 32A-C might be arranged into a pattern 38 in one aspect of the present invention.

In FIG. 2 the internal surface 26 includes a set of second portions 32A, 32B, and 32C, that have a higher rigidity and less pliability than a set of first portions 30A, 30B, and 30C. In accordance with an aspect of the present invention, the second portions 32A, 32B, and 32C include one or more shapes. For example, the second portions 32A-C might include one or more geometric shapes having various sizes and configurations. FIG. 2 depicts one aspect in which the second portions 32A-C include a pattern of various-sized and shaped triangles. And in other aspects, the second portions 32A-C might include additional or different geometric shapes, such as diamonds, squares, rectangles, and the like. In addition, the second portions 32A-C might include organic shapes or configurations.

In a further aspect of the present invention, the first portions 30A-C at least partially demarcate the second portions 32A-C. That is, the first portions 30A-C at least partially circumscribe, envelope, and/or bind the second portions 32A-C, forming a network of interstitial spaces extending throughout the arrangement of the second portions 32A-C. The pattern 38 further includes a series of extended geometric shapes 37 along a side of the pattern 38, which may extend beyond the tubular wall 16 into other areas of an article or item coupled to the tubular wall 16 to add some rigidity to those areas. Alternate patterns, including those with more or fewer shapes, larger or smaller shapes, or different shapes are possible and contemplated. The example shown in FIG. 2 is merely one exemplary configuration.

Figure 3:
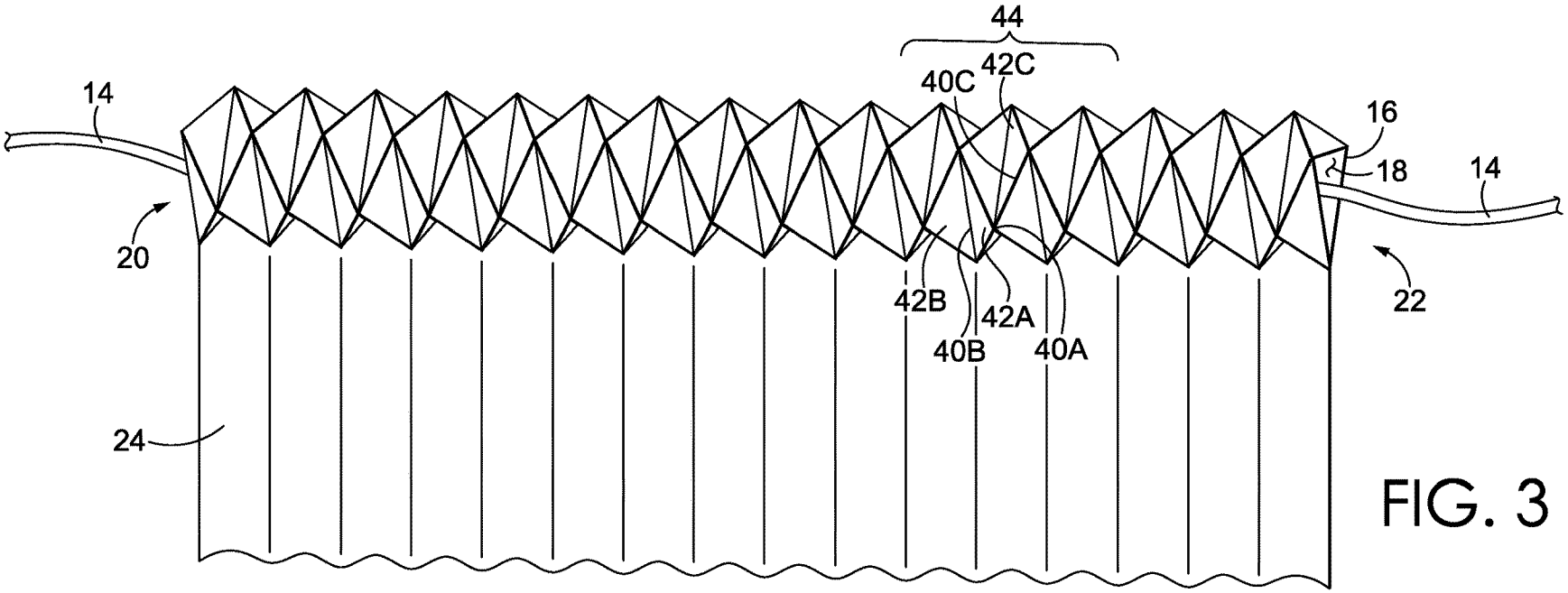
FIG. 3 is a perspective view of an exemplary draw-cord cinching system that has been partially cinched, in accordance with an aspect of the present invention.

Referring now to FIG. 3, a perspective view of an exemplary draw-cord cinching system 10 is depicted with the ends 20 and 22 of the tube 12 partially drawn towards one another. Although hidden from view in FIG. 3, the tubular wall 16 includes some portions (e.g., 30A-C) having increased pliability relative to other portions (e.g., 32A-C). As shown in FIG. 3, when the ends 20 and 22 are drawn towards one another, such as by using the draw cord 14, the tubular wall 16 folds or bends along fold lines 40A, 40B, and 40C, which correspond to respective higher pliability portions (e.g., portions 30A-30C in FIG. 2). In addition, the partially drawn tubular wall 16 includes relatively unfolded faces 42A-C that are relatively flat or planar and that correspond with lower pliability portion (e.g., portions 32A-C in FIG. 2). As a result, a pre-determined pattern 44 is produced when the tube 12 is shortened, and the material of the tubular wall 16 is compacted linearly between the first end 20 of the tube and the second end 22 of the tube. In one aspect, the pre-determined pattern 44 includes a concertinaed-type pattern that allows the tubular wall to expand and contract in a substantially even fashion.

Figure 4:
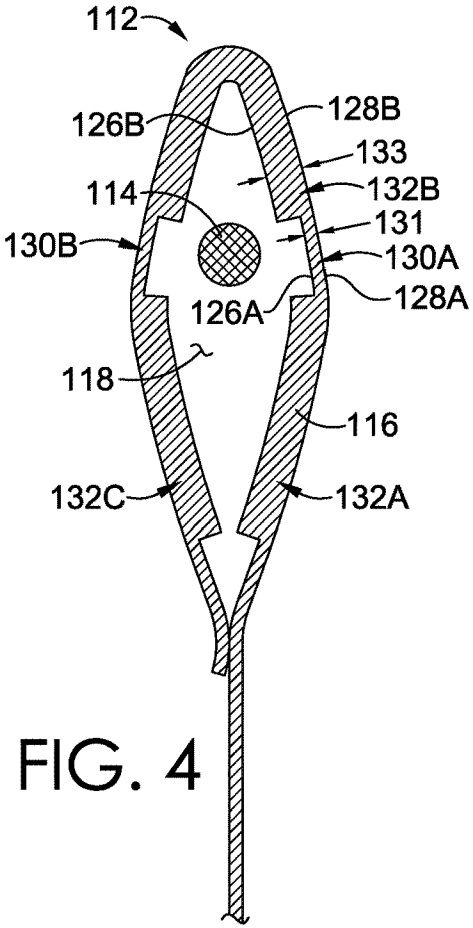
FIG. 4 is a first cross-sectional view of a draw-cord cinching system taken along cut-line 4-4 of FIG. 1, in accordance with an aspect of the present invention.

In FIGS. 1 and 2, the respective pliability of the first portions 30 and 30A-C and the second portions 32 and 32A-C can be tailored using various techniques. For example, the respective thicknesses of the first and second portions can be constructed to create more pliable or more rigid portions, such as by additive or subtractive manufacturing techniques. Referring now to FIG. 4, a first cross-sectional view of a draw-cord cinching system 10 of FIG. 1 along cut-line 2-2 is provided, in one aspect in which pliability is affected by increasing or decreasing a tubular-wall thickness in certain portions.

FIG. 4 depicts a tube 112, a through-channel 118, a draw cord 114, and a tubular wall 116. The tubular wall 116 includes internal surfaces 126A and 126B, which form at least part of a tubular-wall internal surface generally facing towards the through-channel 118. The internal surfaces 126A and 126B form at least part of a tubular-wall internal surface and are identified separately because each identifies a different portion of the tubular-wall internal surface. Both internal surfaces 126A and 126B are considered part of the tubular-wall internal surface. The tubular wall 116 also includes external surfaces 128A and 128B generally opposing the internal surfaces 126A and 126B and facing away from the through-channel 118. The external surfaces 128A and 128B form at least part of a tubular-wall external surface (e.g., 28 in FIG. 1) and are identified separately because each identifies a different portion of the tubular-wall external surface 128. Both external surfaces 128A and 128B are considered part of the tubular-wall external surface.

Additionally, the tubular wall 116 includes a first portion 130A and a second portion 132A, as well as another first portion 130B and other second portions 132B and 132C. In FIG. 4 the first portion 130A includes a first wall thickness 131 measured between the internal surface 126A and the external surface 128A, and the second portion 132B includes a second wall thickness 133, measured between the internal surface 126B and the external surface 128B. In accordance with an aspect of the present invention, the second wall thickness 133 is thicker than the first wall thickness 131, which can at least partially contribute to the second portion 132B being less pliable and more rigid than the first portion 130A.

The respective thicknesses of the first portion 130A and the second portion 132A can be constructed in various manners. For example, an additive layer, or reinforcing backing layer, might be applied to a base layer (or multiple layers making up a base layer), such that the first portion 130A includes the base layer, whereas the second portion 132B (and/or 132A) includes both the base layer and the additive layer. In this respect, the additive layer might be screen printed, 3D printed, stitched (e.g., embroidered), casted, molded, or bonded to the base layer, or applied to the base layer using other suitable techniques. The additive layer might include various types of materials, and in one aspect, the additive layer includes polyurethane molded directly to a fabric layer.

In another aspect, the respective thicknesses might be created by removing at least part of a material layer at the first portion 130A. For example, the first portion 130A might be created by laser etching, routering, or applying some other removal or subtractive technique. Although the first and second portions 130A, 132A, and 132B are shown as an integral material in FIG. 4, composite material sections and/or layers are possible and contemplated.

Figure 5:
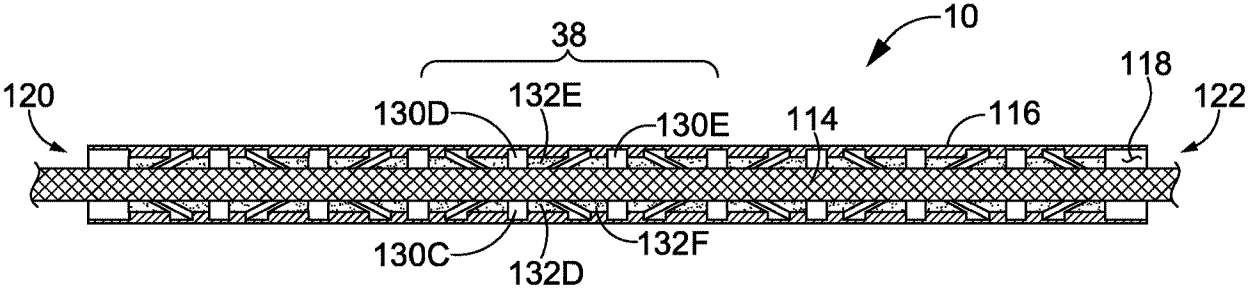
FIG. 5 is another cross-sectional view of a draw-cord cinching system taken along cut line 5-5 of FIG. 1, in accordance with an aspect of the present invention.

Referring now to FIG. 5, another cross-sectional view of a draw-cord cinching system is depicted along cut line 5-5 in FIG. 1, in one aspect in which pliability is affected by increasing or decreasing a tubular-wall thickness in certain portions. In FIG. 5, the first portions 130C-E and the second portions 132D-F are depicted along a top-oriented portion of the tubular wall 116. As shown in the exemplary aspect of FIG. 5, the first and second portions 130C-E and 132D-F of the tubular wall 116 have different respective thicknesses, which may be selected to provide different respective pliabilities. As explained in other parts of this description, varied thickness can be achieved by adding material layers to a base layer or by removing material layers from a base layer. In accordance with an aspect of the present invention, when the ends 120 and 122 of the tube are drawn towards one another, the tubular wall 116 tends to bend or fold at the first portions 130C-E having a higher relative pliability, before folding or bending at the second portions 132D-F. By positioning the lower pliability portion and the higher pliability portion in a particular arrangement (e.g., FIG. 2), the tubular wall 116 folds in a substantially pre-determined manner when drawn.

FIGS. 4 and 5 illustrate one aspect in which the various portions of the tubular wall are constructed to include different thicknesses in order to create regions of higher and lower respective pliability. In other aspects, regions of higher and lower respective pliability might be created using other techniques. For example, the portions 30 and 32 (FIG. 1) might be constructed of respective sets of thread or filament to achieve a desired amount of pliability, such as by using certain weaving or knitting techniques that selectively place thread elements in certain zones. In another aspect, one or more portions of the tubular wall might be heat pressed in order to modify the pliability. These are merely exemplary techniques that might be used, and other techniques are possible.

In one aspect of the present invention, the areas of lower respective pliability (e.g., 32 and 32A-E) include a substantially similar amount of pliability, and similarly, the areas of higher respective pliability (e.g., 30 and 30A-E) include a substantially similar amount of pliability. In an alternative embodiment, the regions of lower pliability might include various amounts of pliability that fall within a range of pliability, which is lower than another range of pliability of the higher respective pliability regions. In other words, two different lower pliability portions might have different levels of pliability, both of which are lower than the higher pliability portions. In addition, the draw-cinching system 10 might include one or more different patterns of higher and lower pliability portions along the same tubular wall in order to create different arrangements within the same cinched tubular wall.

Figure 6:
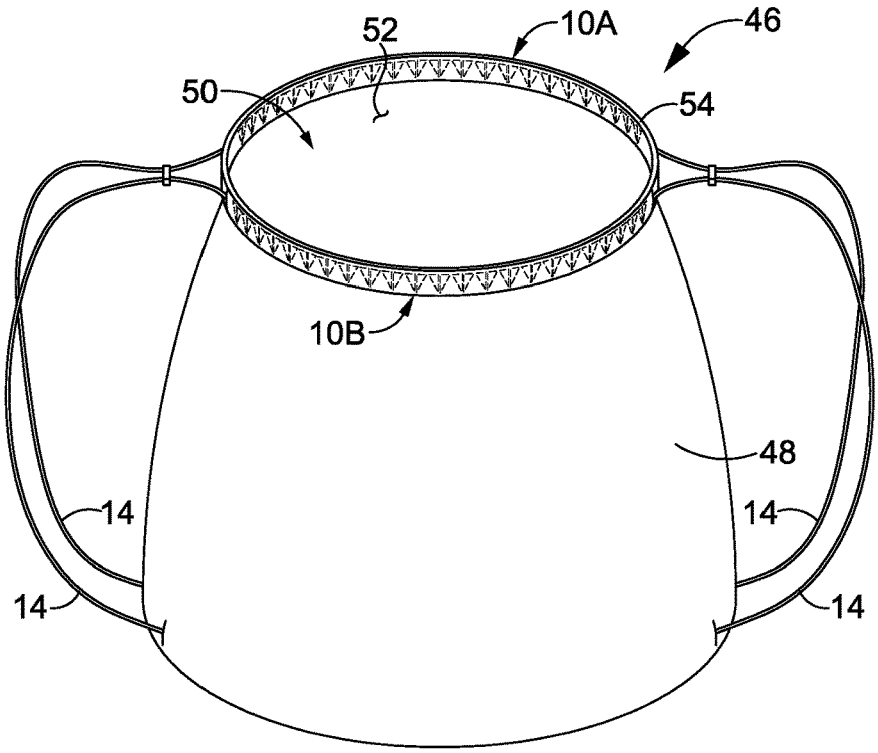
FIG. 6 is a perspective view of a bag with a draw-cord cinching system, in accordance with an aspect of the present invention.

As previously indicated, the draw-cord cinching system 10 might be incorporated into various types of articles that include a drawstring to control an opening size and/or to adjust a sizing. Referring to FIG. 6, a bag 46 is depicted, such as a track sack, track bag, drawstring bag, drawstring backpack, or other drawstring-style bag. The bag 46 includes a body portion 48 that at least partially encloses a storage space 52 and that includes an opening 50 to provide access to the storage space 52. A collar portion 54 is shown coupled to the body portion 48. The collar portion 54 forms a perimeter around at least a portion of the opening 50. The collar portion 54 includes a draw-cord cinching system that is described with respect to FIGS. 1-3 and that is useable to help close the opening 50. That is, the bag 46 includes a first draw-cord cinching system 10A and a second draw-cord cinching system 10B, the first and second systems 10A and 10B for helping close respective parts of the collar.

Figure 7:
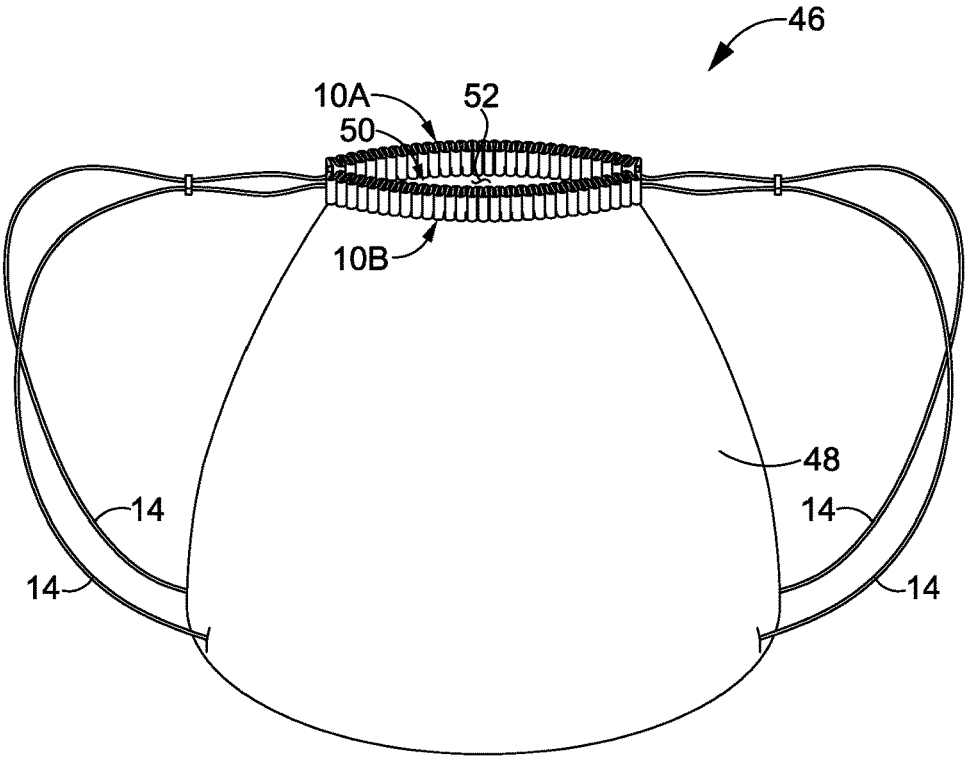
FIG. 7 is a perspective view of the bag of FIG. 6 with a draw cord pulled, in accordance with an aspect of the present invention.

Referring to FIG. 7, a perspective view of the bag 46 of FIG. 6 is illustrated with the draw cord 14 used to reduce a size of the opening 50. As depicted, the first and second systems 10A and 10B are drawn in a substantially pre-determined pattern (e.g., pattern 44 depicted in FIG. 3) based on the arrangement of higher and lower pliability portions. As previously described, the pattern is formed from the fold lines and the rigid areas (e.g., elements 40A-C and 42A-C of FIG. 3) when the draw cords 14 are pulled.

Figure 9:
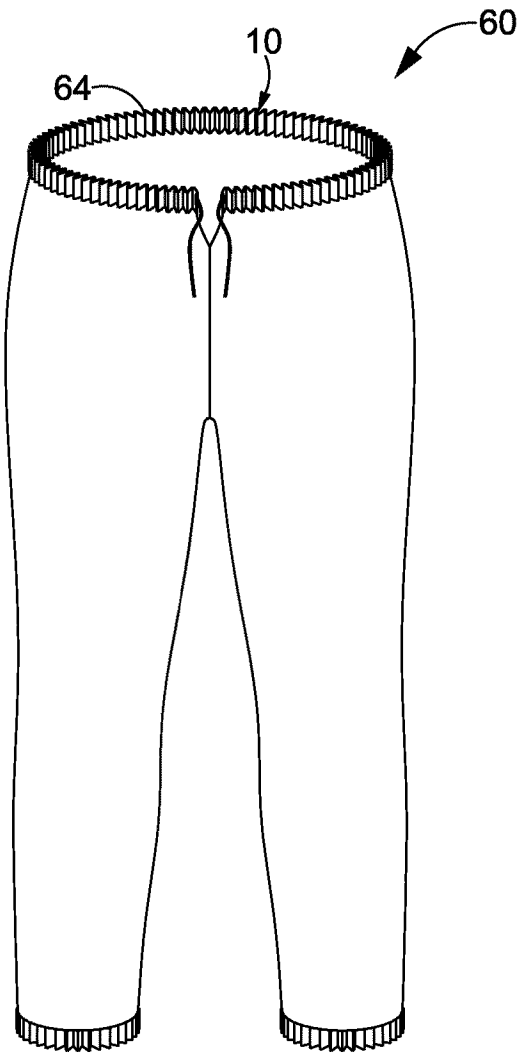
FIG. 9 is a perspective view of a lower-body garment incorporating a draw-cord cinching system, in accordance with an aspect of the present invention.
Figure 8:
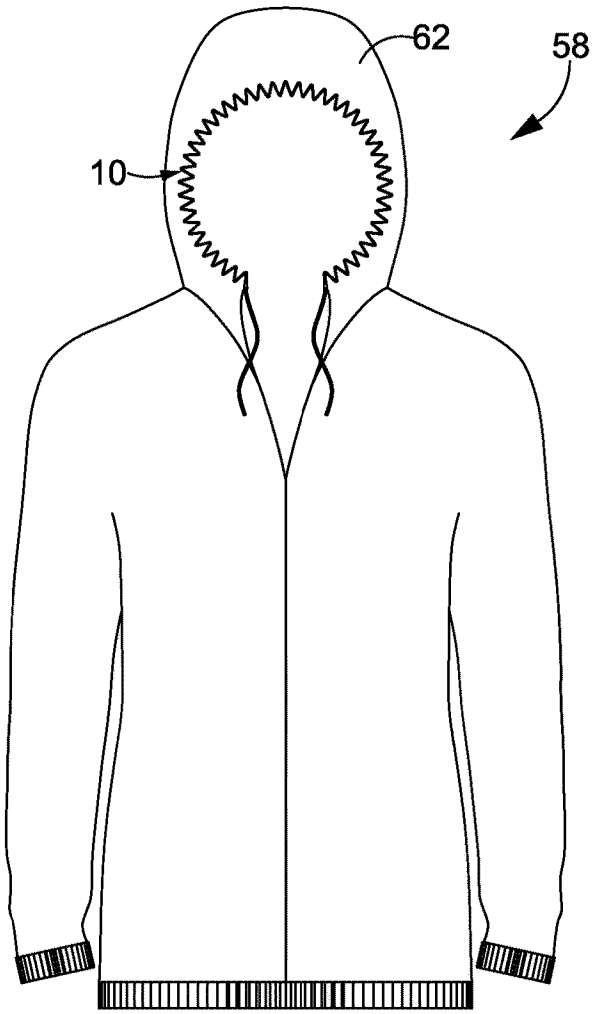
FIG. 8 is a perspective view of an upper-body garment incorporating a draw-cord cinching system, in accordance with an aspect of the present invention.

Referring now to FIGS. 8 and 9, a perspective view of an upper-body garment 58 and a lower-body garment 60, respectively, incorporating the draw-cord cinching system 10, is provided. In FIG. 9, the upper-body garment 58 (e.g., jacket, zip-up hoodie, or the like) has the cinching system 10 incorporated into a hood 62 in accordance with an aspect of the present invention. In addition, the upper-body garment 58 includes the cinching system incorporated into a waist area of the garment and into arm-sleeve cuffs. In FIG. 9, the lower-body garment 60 has the cinching system 10 incorporated into a waist 64 in accordance with an aspect of the present invention. In addition, the lower-body garment 60 includes the cinching system incorporated into leg-sleeve cuffs. Although the garments 58 and 60 include the draw-cord cinching system 10 in multiple areas of the garments 58 and 60, the garments 58 and 60 might include the cinching system 10 in less than all of these areas. For example, the upper-body garment 58 might include the cinching system 10 in the hood 62 of the garment, but not in the waist area or cuff.

Having described the various figures, other aspects will now be described in accordance with different aspects of the present invention. When describing these other aspects, reference might be made to the figures for illustrative purposes. One aspect includes a draw-cord cinching system (e.g., system 10 in FIG. 1). The system includes a tubular wall (e.g., 16) forming a tube (e.g., 12) having a through-channel (e.g., 18) extending from a first end of the tube to a second end of the tube. A first portion (e.g., 30) of the tubular wall includes a first amount of pliability, and a second portion (e.g., 32) of the tubular wall, which is at least partially circumscribed by the first portion of the tubular wall, includes a second amount of pliability that is less than the first amount of pliability. In addition, the system includes draw cord positioned in the through-channel.

Another aspect of the present invention is directed to a draw-cord cinching system (e.g., system 10 in FIG. 1), which includes a tube (e.g., 12) formed by a tubular wall (e.g., 16). A pattern of geometric shaped portions (e.g., portions 32A-C in FIG. 2) may be positioned along the tubular wall, with each geometric-shaped portion in the pattern including a first amount of pliability. Interstitial portions (e.g., portions 30A-C in FIG. 2) extending between the geometric shaped portions in the pattern of geometric shaped portions may also be provided, with the interstitial portions including a second amount of pliability that is greater than the first amount of pliability. The pattern of geometric-shaped portions may include a series of thermoplastic polymer members cast onto a textile layer.

In addition, an aspect includes a drawstring-style bag (e.g., bag 46 in FIGS. 6 and 7). The bag includes a body portion (e.g., 48) that at least partially encloses a storage space (e.g., 50) and that includes an opening (e.g., 52) for access to the storage space. In addition, the bag includes a collar portion (e.g., 54) coupled to the body portion and forming a perimeter around at least part of the opening, the collar portion including a tubular structure (e.g., tube 12 of FIG. 1) formed by a tubular wall (e.g., 16). The tubular structure includes a through-channel (e.g., 18) extending from a first end of the tubular structure to a second end of the tubular structure. In addition, a first portion of the tubular wall (e.g., 30) includes a first amount of pliability, and a second portion of the tubular wall (e.g., 32), at least partially circumscribed by the first portion, includes a second amount of pliability, which is less than the first amount of pliability. A draw cord is positioned in the through-channel and is operable to reduce a size of the opening by shortening a length of the tubular structure by drawing the first end towards the second end. Tubular-wall bends are formed along the first portion when the first end is drawn towards the second end.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made of the invention without departing from the scope thereof, it is to be understood that all matter herein set forth or shown in the accompanying drawings is to be interpreted as illustrative and non-limiting.

What is claimed is:

1. A garment, comprising:

a collar that forms a portion of the garment;

a draw-cord cinching system, comprising:

a tubular wall forming a tube having a through-channel extending from a first end of the tube to a second end of the tube, wherein the tube forms at least a portion of the collar, the tubular wall including a first portion and a second portion, the first portion comprising a base layer having a first thickness, the first portion circumscribing the through-channel along at least part of a length of the tube, and the second portion comprising the base layer and an additive layer comprising a plurality of distinct and non-interconnected geometric-shaped portions, the second portion at least partially circumscribed by the first portion and having a second thickness that is greater than the first thickness; and a draw-cord positioned in the through-channel.

2. The garment of claim 1, wherein the garment is a hooded garment having a hood, and wherein the collar forms at least a portion of a perimeter of a face opening of the hood.

3. The garment of claim 1, wherein the collar forms a portion of a cuff of the garment.

4. The garment of claim 3, wherein the garment is an upper-body garment.

5. The garment of claim 3, wherein the garment is a lower-body garment.

6. The garment of claim 1, wherein the garment is a lower-body garment, and wherein the collar forms at least a portion of a waistband of the lower-body garment.

7. The garment of claim 1, wherein the base layer comprises a textile, and wherein the plurality of geometric-shaped portions are cast onto the base layer.

8. The garment of claim 1, wherein the tube is formed from a folded-over portion of the base layer that is attached to itself to form the tube.

9. The garment of claim 1, wherein the tube includes a tube length measured from the first end of the tube to the second end of the tube, and wherein the first portion of the tubular wall comprises a fold line at which tubular wall folds are formed when the tube length is shortened by drawing the first end of the tube towards the second end of the tube.

10. A draw-cord cinching system for a garment, comprising:

a tubular wall forming a tube having a through-channel extending from a first end of the tube to a second end of the tube, the tubular wall including a first portion and a second portion, the first portion comprising a base layer having a first thickness, the first portion circumscribing the through-channel along at least part of a length of the tube, and the second portion comprising the base layer and an additive layer comprising a plurality of distinct and non-interconnected geometric-shaped portions, the second portion at least partially circumscribed by the first portion and having a second thickness that is greater than the first thickness; and a draw-cord positioned in the through-channel.

11. The draw-cord cinching system for a garment of claim 10, wherein the garment is a hooded garment having a hood with a face opening, and wherein the draw-cord cinching system forms at least a portion of a perimeter around the face opening.

12. The draw-cord cinching system for a garment of claim 10, wherein the garment is a lower-body garment, and wherein the draw-cord cinching system forms at least a portion of a waistband of the garment.

13. The draw-cord cinching system for a garment of claim 10, wherein the draw-cord cinching system forms at least a portion of a cuff of the garment.

14. The draw-cord cinching system for a garment of claim 13, wherein the garment is an upper-body garment.

15. The draw-cord cinching system for a garment of claim 13, wherein the garment is a lower-body garment.

16. A hooded garment with an engineered design closure mechanism, the hooded garment comprising:

an upper-body-covering portion;

a hood coupled to the upper-body-covering portion and having a face opening;

a pair of arm portions coupled to the upper-body-covering portion;

a collar that forms a perimeter around at least a portion of the face opening;

a draw-cord cinching system coupled to the hood, the draw-cord cinching system comprising:

a tubular wall forming a tube having a through-channel extending from a first end of the tube to a second end of the tube, wherein the tube forms at least a portion of the collar, the tubular wall including a first portion and a second portion, the first portion comprising a base layer having a first thickness, the first portion circumscribing the through-channel along at least part of a length of the tube, and the second portion comprising the base layer and an additive layer comprising a plurality of distinct and non-interconnected geometric-shaped portions, the second portion at least partially circumscribed by the first portion and having a second thickness that is greater than the first thickness; and a draw-cord positioned in the through-channel.

17. The hooded garment of claim 16, wherein the garment is a jacket.

18. The hooded garment of claim 16, wherein the garment is a zip-up hoodie.

19. The hooded garment of claim 16, wherein the base layer comprises a textile and the additive layer is cast onto the base layer.

20. The hooded garment of claim 19, wherein the additive layer comprises a polymer material.

* * * * *